US008611794B2

(12) United States Patent
Ikeguchi

(10) Patent No.: US 8,611,794 B2
(45) Date of Patent: Dec. 17, 2013

(54) DEVELOPER REPLENISHING DEVICE, IMAGE FORMING APPARATUS, AND DEVELOPER REPLENISHING METHOD

(75) Inventor: Hiroshi Ikeguchi, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 242 days.

(21) Appl. No.: 13/028,572

(22) Filed: Feb. 16, 2011

(65) Prior Publication Data

US 2011/0200365 A1 Aug. 18, 2011

(30) Foreign Application Priority Data

Feb. 18, 2010 (JP) ..... 2010-033752

(51) Int. Cl.
*G03G 15/08* (2006.01)

(52) U.S. Cl.
USPC ..... 399/158

(58) Field of Classification Search
USPC ..... 399/258
See application file for complete search history.

(56) References Cited

U.S. PATENT DOCUMENTS

| | | | | |
|---|---|---|---|---|
| 6,215,974 | B1 * | 4/2001 | Katoh et al. | 399/258 |
| 7,181,155 | B2 | 2/2007 | Aoki et al. | |
| 7,831,180 | B2 * | 11/2010 | Toh et al. | 399/254 |
| 2002/0025195 | A1 * | 2/2002 | Iwata et al. | 399/258 |
| 2002/0025196 | A1 * | 2/2002 | Matsumoto et al. | 399/258 |
| 2003/0235436 | A1 * | 12/2003 | Kasahara et al. | 399/258 |
| 2004/0179866 | A1 * | 9/2004 | Muramatsu et al. | 399/258 |
| 2008/0038019 | A1 * | 2/2008 | Kasahara et al. | 399/222 |
| 2009/0162106 | A1 * | 6/2009 | Hattori et al. | 399/261 |

FOREIGN PATENT DOCUMENTS

| | | | |
|---|---|---|---|
| JP | 2002099136 A | * | 4/2002 |
| JP | 2002-268346 | | 9/2002 |

OTHER PUBLICATIONS

Machine translation of JP 2002099136 A.*

* cited by examiner

*Primary Examiner* — Walter L Lindsay, Jr.
*Assistant Examiner* — David Bolduc
(74) *Attorney, Agent, or Firm* — Oblon, Spivak, McClelland, Maier & Neustadt, L.L.P.

(57) ABSTRACT

A developer replenishing device for replenishing a developer to a development device includes a developer housing container configured to house the developer inside the container, a discharge outlet provided on the developer housing container and configured to discharge the housed developer outside the container, a conveying device provided between the discharge outlet and the development device, and configured to convey the developer in the developer housing container to the development device, and a motion providing device configured to provide a periodic motion to the developer housing container. The periodic motion is a circling motion, in which a trajectory of an arbitrary point of the developer housing container on a horizontal plane is at least one of circular and ellipsoidal trajectories, without a fixed rotation center on the horizontal plane.

17 Claims, 11 Drawing Sheets

OBLON ET AL (703) 413-3000
DOCKET # 376066US28
INV. Hiroshi IKEGUCHI
USSN 13/028,572
REPLACEMENT SHEET(S)

P1
P2
P3
11A
14
141
142
143

DEVELOPER REPLENISHING DEVICE, IMAGE FORMING APPARATUS, AND DEVELOPER REPLENISHING METHOD

CROSS REFERENCE TO RELATED APPLICATIONS

The present application is based on and claims priority from Japanese Application Number 2010-033752, filed on Feb. 18, 2010, the disclosure of which is hereby incorporated by reference herein in its entirety.

BACKGROUND OF THE INVENTION

1. Field of the Invention

The present invention relates to a developer replenishing device to replenish a developer to a development device, an image forming apparatus, which includes the same, such as a printer, a facsimile machine, or a copier, and a developer replenishing method.

2. Description of the Related Art

Generally, a developer, also called a toner or a carrier, is supplied from a development device, and thereby an image forming apparatus forms a toner image on a latent image made on an image carrier. Since the developer is consumed with forming an image, a developer housing container (hereinafter, referred to as a housing container), which houses the developer, such as a toner bottle or a toner cartridge, is set to an image forming apparatus body, the developer is replenished from the housing container to the development device, and after the developer in the housing container being used runs out, the used housing container is replaced with a housing container which houses a new developer.

Regarding a developer replenishing device to replenish the developer to the development device used for the image forming apparatus, as shown in FIGS. 16A to 16C, there is one in which a conveying member such as a screw, an auger, a coil, and an agitator is provided in a housing container, the conveying member is driven and rotated from outside of the housing container, and thereby a developer is conveyed to a discharge outlet of the container, and one in which a spiral groove or protrusion is formed on an outer circumference of a tubular housing container, the housing container itself is rotated, and a developer is conveyed to a discharge outlet.

Regarding the housing container, there is one in a hard-bottle type, which maintains its shape also after using as a cartridge and a bottle, and a flexible one in a soft type, which can reduce a volume of the container. In a case of the hard-bottle type, there is a big problem in recycling of a used container with a replacement of the housing container. Although the used housing container is collected from users to manufacturers, and a reproduction, a recycle, or an incineration treatment is performed, a volume of the housing container of the hard-bottle type increases, and expensive logistics costs for recovery and transport of the housing container of the hard-bottle type from the users to the manufacturers are needed. Further, in a case where the developer is refilled in the recovered housing container to try reusing the housing container, there are difficulties in a cleaning operation of the recovered housing container and in toner-filling efficiency and expensive costs for reusing the housing container are also needed.

In a case of the soft type, a suction nozzle is inserted to the discharge outlet provided on the flexible housing container to provide air current, suction power is generated in a conveying device such as a powder pump, and the developer is sucked and replenished to the development device. In this case, the volume of the container is automatically reduced as the developer inside the container is reduced. In a case of the soft type, since there is no conveying member in the housing container, there is an advantage in that the housing container can be reduced in the volume when recovered. On the contrary, there is a problem in that it is difficult to make a horizontally-long powder container which is longer in a horizontal direction than in a vertical direction, can be installed parallel to a photoreceptor body and the development device, and has an advantage in downsizing of the entirety of the image forming apparatus. That is, in a case where the flexible housing container is placed in the horizontal direction, since there is no conveying member, the spiral groove is formed on the container, the container is rotated, and thereby a conveying action needs to be provided. However, if the container is rotated, since the container itself is twisted, it is difficult to stably convey the developer. Further, although it may be thought that the developer becomes broken when conveyed to the discharge outlet by its own weight, since an angle in which the gravity to move the developer is utilized sufficiently cannot be obtained, there is a problem in that the developer becomes cross-linked to each other, and the developer cannot be discharged and remains in the powder container.

Accordingly, since a previous flexible housing container is inclined toward the discharge outlet of the container, inclination thereof has a slightly larger angle than a rest angle of powder to be used. Generally, since the angle of inclination is 50 degrees or more, the housing container has to be installed so as to be long in the vertical direction in the image forming apparatus, and there are restrictions for a shape of the image forming apparatus and the volume of the container.

In Japanese Patent Laid-Open Publication Number 2002-268346, there is disclosed a toner replenishing device which is a flexible toner housing container to house a developer such as a toner and a carrier used for an electrophotographic device inside, of which a horizontal lower surface is composed of a rigid body; and in which a reciprocating motion having different acceleration speeds in an approach path and a return path in an approximately horizontal direction on a horizontal plane connecting a central part of the container and the discharge outlet for the developer is provided to the housing container, and the toner inside is moved and discharged from the discharge outlet in series.

In Japanese Patent Laid-Open Publication Number 2002-268346, a unidirectional linear motion is provided to the housing container and the toner held therein. In this manner, the unidirectional linear motion is provided to the housing container, and thereby it is possible for the toner to be fluidized. However, there is a problem in that a large vibration is necessary, agitation is insufficient, toner fluidization requires time, or in an opposite manner, blocking occurs by an action similar to tapping, and thereby the toner remains in the housing container. Further, although it may be thought that the housing container is placed in the vertical direction to be rotated, in this case, there is a problem in that the blocking of the developer may occur by action of the tapping, and thereby the toner remains in the housing container.

SUMMARY OF THE INVENTION

An object of the present invention is to provide a developer replenishing device in which a developer in a developer housing container is efficiently fluidized while the configuration of the container to house the developer is kept simple, and thereby the developer is capable of being stably conveyed as the amount of the developer remaining in the housing container is reduced.

In addition, a further object of the present invention is to provide an image forming apparatus including the developer replenishing device, in which the developer is stably supplied, and thereby a good image is capable of being obtained, and a developer replenishing method used in the developer replenishing device.

To achieve the above object, a developer replenishing device for replenishing a developer to a development device according to an embodiment of the present invention includes a developer housing container configured to house the developer inside the container, a discharge outlet provided on the developer housing container and configured to discharge the housed developer outside the container, a conveying device provided between the discharge outlet and the development device, and configured to convey the developer in the developer housing container to the development device, and a motion providing device configured to provide a periodic motion to the developer housing container. The periodic motion is a circling motion, in which a trajectory of an arbitrary point of the developer housing container on a horizontal plane is at least one of circular and ellipsoidal trajectories, without a fixed rotation center on the horizontal plane.

BRIEF DESCRIPTION OF THE DRAWINGS

FIG. 3A is the view showing an initial state, and FIG. 3B is the view showing a state in which a developer obtains fluidity by motion.

FIG. 4A is the view showing an initial state, and FIG. 4B is the view showing a state in which the developer is reduced by the motion, and volume of the container is reduced.

FIG. 5A is the view showing the configuration in which a discharge outlet is formed on a lower surface of the container, and FIG. 5B is the view showing the configuration in which the discharge outlet is formed on a lower portion of a side surface of the container.

FIG. 15A is the view showing an initial state, and FIG. 15B is the view showing a state when the container is transformed by the developer being reduced.

DETAILED DESCRIPTION OF THE PREFERRED EMBODIMENTS

Hereinafter, embodiments of the present invention will be explained in detail with reference to the accompanying drawings. In each of the embodiments, it is possible for the same reference number to be used for composition elements such as members or component parts which have the same function or form, and a duplicate explanation will be omitted.

Figure 2:
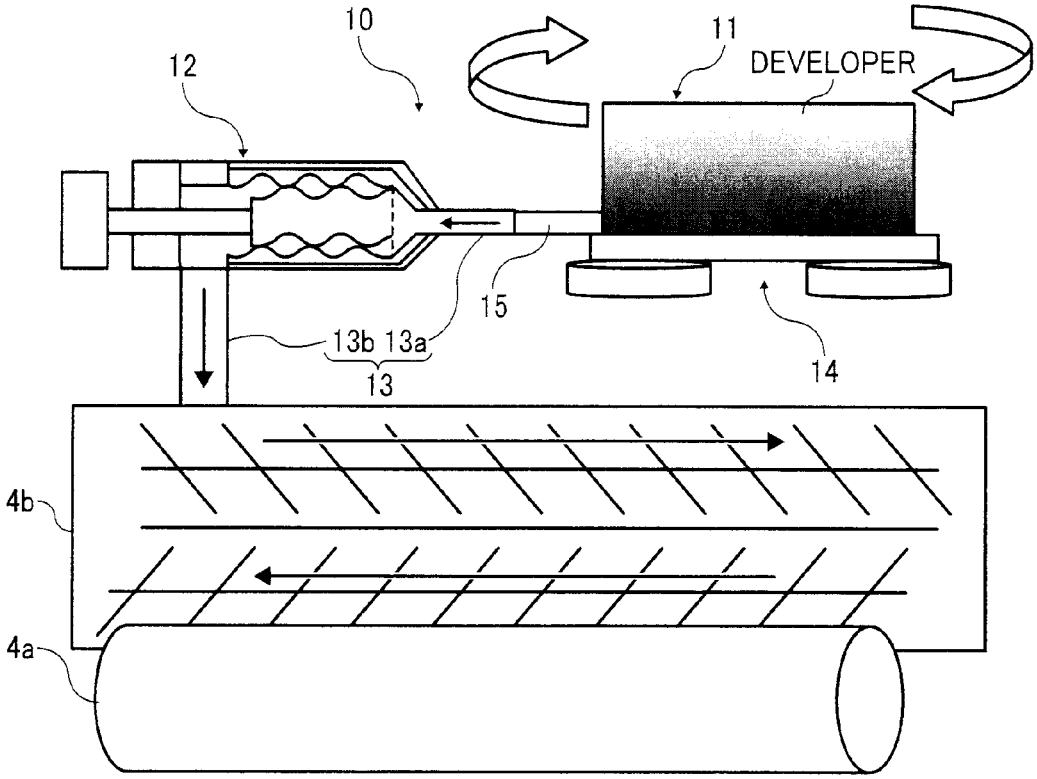
FIG. 2 is a view showing a schematic configuration of a developer replenishing device which is a major portion according to an embodiment of the present invention.

A developer replenishing device 10 according to an embodiment of the present invention, which is for replenishing a developer to a development device 4, includes, for example, as shown in FIG. 2, a developer housing container 11 configured to house the developer inside the container 11, a discharge outlet 15 provided on the developer housing container 11 and configured to discharge the housed developer outside the container 11, a conveying device provided between the discharge outlet 15 and the development device 4, and configured to convey the developer in the developer housing container 11 to the development device 4, and a motion providing device 14 configured to provide a periodic motion to the developer housing container 11. The periodic motion is a circling motion, in which a trajectory of an arbitrary point P1 of the developer housing container 11 on a horizontal plane, for example, a center point P1 of a lower surface 11A of the container is at least one of circular and ellipsoidal trajectories, without a fixed rotation center on the horizontal plane.

Figure 1:
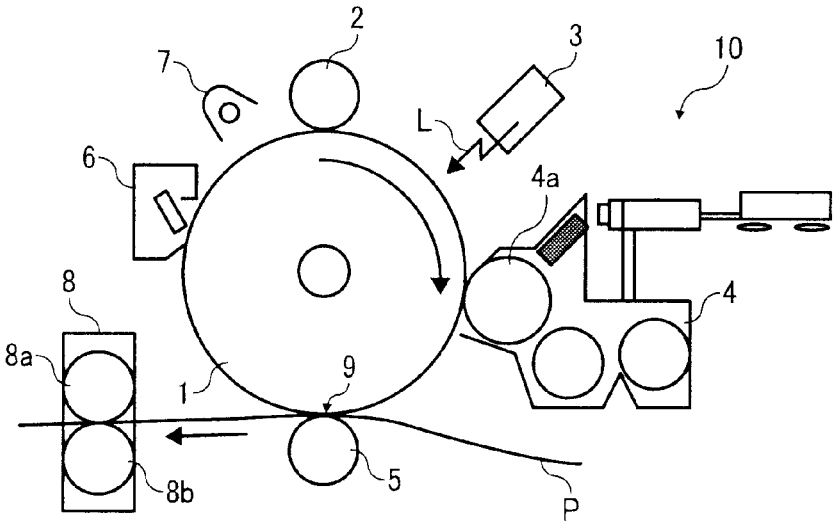
FIG. 1 is a view showing a schematic configuration of an image forming apparatus according to an embodiment of the present invention.

A printer in an electrophotographic system (hereinafter, simply referred to as a printer) will be explained as an embodiment of an image forming apparatus to which the present invention is applied. At first, a basic configuration of a black-and-white printer according to the embodiment will be explained. FIG. 1 is a schematic diagram showing a printer according to the embodiment. The printer includes an electrifying device 2, an optical writing device 3, the development device 4, a transfer device 5, a drum cleaning device 6, and a charge eliminating device 7 around a drum-shape photoreceptor body 1 which is an image carrier. A fixing device 8 is provided in a left-side direction of the transfer device 5 in the drawing, and the developer replenishing device 10 is connected to the development device 4.

In the photoreceptor body 1 rotated and driven in a clockwise direction in the drawing by a driving motor (not shown), an organic photosensitive layer is formed on a surface of an element tube made of aluminum and the like, and the photoreceptor body 1 is uniformly electrified to a positive or negative electrode-characteristic by the electrifying device 2 as the photoreceptor body 1 is rotated. Further, a potential of an exposed part of the photoreceptor body 1 is decreased by scanning of laser light L emitted from the optical writing device 3 that structures optical scanning information based on image information sent from a personal computer and the like (not shown). Accordingly, an electrostatic latent image having a smaller potential than that of a bare part around the exposed part is carried. When passing a development position facing a position of the development device 4 as the photoreceptor body 1 is rotated, the electrostatic latent image is slid in contact with the developer, which is a two-component developer containing a toner and a magnetic carrier carried by a developing roller 4*a* of the development device 4. Further, for example, in a case where a negative-positive process is adopted, a negative electrode-characteristic toner contained in the developer electrostatically attaches to the exposed part of the negatively electrified photoreceptor body 1, and the electrostatic latent image is developed into a toner image.

A transfer position 9 at which the photoreceptor body 1 and the transfer device 5 are opposite to each other is formed in a downstream side from the development position in a photoreceptor-body rotation direction. When entering the transfer position 9 as the photoreceptor body 1 is rotated, the toner image developed on the photoreceptor body 1 is overlapped with sheet-shape transfer paper P, for example, a recording body P conveyed in correct timing by a sheet feeding device (not shown). Further, the toner image developed on the photoreceptor body 1 is affected by a transfer electric-field formed between the exposed part of the photoreceptor body 1 and the transfer device 5, and is electrostatically transferred on the recording body P. The transfer paper P electrostatically attaching to the photoreceptor body 1 in such an electrostatic transfer is separated from the photoreceptor body 1 by actions of a weight and stiffness of the paper, a member (not shown) to separate the paper and convey the separated paper, and the like. As mentioned above, the recording body P on which the toner image is electrostatically transferred is sent from the transfer position 9 to the fixing device 8.

A fixation nip is formed by contact of a heating roller 8*a* having a heat source (not shown) inside thereof with a pressing roller 8*b* pressing the heating roller 8*a* in the fixing device 8. These rollers are rotated and driven so that surfaces of the rollers are moved in a same direction at contacting parts of each other. The recording body P sent to the fixing device 8 having such a configuration is nipped at the fixation nip and conveyed in a moving direction of the surfaces of the rollers. On this occasion, the toner image is fixed by influences of a nip pressure and heating. The transfer paper P after the fixation is discharged outside of the printer via a sheet discharging device (not shown).

When a surface of the photoreceptor body 1 having passed the transfer position 9 passes a position facing the drum cleaning device 6 as the photoreceptor body 1 is rotated, a transfer residual toner on the surface of the photoreceptor body 1 is cleaned. Further, after a remaining electric charge is removed by the charge eliminating device 7, the surface of the photoreceptor body 1 is uniformly electrified by the electrifying device 2 and returns to an initial state.

In a charge eliminating method, a system which forcibly decreases a potential by utilizing a corona electrification or a system which decreases a remaining potential by irradiating the photoreceptor body 1 with light to be exposed may be used. It is possible that the charge eliminating device 7 be omitted in accordance with a type of the photoreceptor body 1 or an electrification system.

In FIG. 1, the electrifying device 2 with a system in which a bias member such as an electrifying roller, to which an electrification bias is applied, has contact with the photoreceptor body 1 is shown. However, such as an electrifying charger with a noncontact system may be used. The optical writing device 3 which is configured to form the electrostatic latent image by irradiating with the laser light L is shown as an example. However, the optical writing device 3 which is configured to perform optical writing by means of LED light from an LED array may be used. Further, a device which directly draws and forms the electrostatic latent image on the image carrier by means of ion irradiation and the like also may be used without forming the electrostatic latent image by means of electrifying and optical writing by the use of the drum-shape photoreceptor body 1.

The transfer device 5 with a roller-contact system in which a transfer roller, to which a transfer bias is applied, has contact with the photoreceptor body 1 is shown. However, the transfer device 5 with a belt-contact system in which a belt has contact with the photoreceptor body 1, or such as a transfer charger with a noncontact system may be used. The drum cleaning device 6 with a scraping system by means of a cleaning blade is shown. However, the drum cleaning device with an electrostatic recovering system in which a brush or a roller, to which a cleaning bias is applied, has contact with the photoreceptor body 1 may be used. An example in which the drum-shape photoreceptor body 1 is provided is explained as the image carrier. However, a belt-shape photoreceptor body and the like may be used.

In FIG. 1, an example of the printer in which the photoreceptor body 1 and the devices around the photoreceptor body 1 are individually provided is explained as the image forming apparatus. However, an image forming apparatus including a process-cartridge housing the photoreceptor body 1 and the devices around the photoreceptor body 1 as one unit in a common casing may be used. For example, the photoreceptor body 1, the electrifying device 2, the development device 4, and the drum cleaning device 6 are constructed as one process unit so as to be attachable to and detachable from a body of the printer.

The development device 4 has an agitation-circulation section 4*b* having two screws, which circulate the two-component developer containing the magnetic carrier in a pathway and the developing roller 4*a* including a magnet. The developer from the developer replenishing device 10 is conveyed to the agitation-circulation section 4*b*. A surface of the developing roller 4*a* is finished in a rough state in a range of 5 to 20 μm RZ by means of a sandblasting processing. Various blasting processings may be used as a substitute for such a processing on the surface. Further, a plurality of grooves having a depth of 0.05 to 1 mm may be formed as a substitute for the blasting processings. Since the toner stored in the development device 4 decreases when the toner image is formed on the image carrier, the developer (including mainly the toner) is replenished from the developer replenishing device 10.

As shown in FIG. 2, the developer replenishing device 10 includes the developer housing container 11 in which the developer to be replenished is filled and housed, a powder pump 12 and a conveying path 13, which are the conveying device configured to convey the developer in the developer housing container 11 to the agitation-circulation section 4*b*, and the motion providing device 14 configured to apply power from outside to provide the periodic motion to the developer housing container 11.

The conveying device may include the powder pump 12 configured to generate suction power and a pipeline member configured to connect the powder pump 12 and the discharge outlet 15. The powder pump 12 is operated, so that the developer in the developer housing container 11 is sucked and conveyed to the development device 4.

The discharge outlet 15, which discharges the developer housed in the container outside thereof, is provided on the developer housing container 11. The discharge outlet 15 and a suction side of the powder pump 12 communicate with a suction pipe 13*a* which is the pipeline member constituting the conveying path 13. A discharge side of the powder pump 12 and the agitation-circulation section 4*b* communicate with a conveying pipe 13*b* constituting the conveying path 13.

When the powder pump 12 is operated, the developer replenishing device 10 sucks the developer housed in the developer housing container 11 from the suction pipe 13*a* into the powder pump 12 by means of suction power of the powder pump 12, supplies and conveys the sucked developer to the agitation-circulation section 4*b* via the conveying pipe 13*b*, and also provides the periodic motion to the developer housing container 11 by operating the motion providing device 14.

When the periodic motion is provided on the developer housing container 11, motion power reaches the housed developer (toner), and the developer is fluidized. By being fluidized, the developer is sucked by the powder pump 12 connected to the suction pipe 13*a* communicating with the discharge outlet 15, and the toner is replenished to the agitation-circulation section 4*b* of the development device 4. A toner concentration detecting device (not shown) and the like are provided as needed in the agitation-circulation section 4*b*. When toner concentration of the developer in the development device 4 decreases, the developer replenishing device 10 is started, and the developer (toner) is replenished. Thus, the concentration of the developer in the development device 4 is stabilized, and thereby an output image can be kept to a good quality.

The pipeline member may be composed of a flexible member.

When the periodic motion is provided on the developer housing container 11, since an installation position of the developer housing container 11 and an installation position of the powder pump 12 constantly change, the flexible member having flexibility and elasticity such as a rubber and a resin is used for the suction pipe 13*a* connecting the developer housing container 11 and the powder pump 12. If an inside diameter of the suction pipe 13*a* is, for example, in a range of 2 to 10 mm, it is possible to convey the fluidized developer. In this embodiment, a silicone pipe having the inside diameter of 6 mm is used. In addition, a urethane resin pipe, a fluorine resin pipe, a nylon tube, and a polyester tube may be used. In some cases, a metallic bellows pipe with a length capable of being adjusted may be also used instead of the pipes or tubes of the resin or rubber member. In short, even if a positional relationship between the developer housing container 11 and the powder pump 12 is changed, a configuration in that displacement of the developer housing container 11 and the powder pump 12 can be flexibly absorbed at the suction pipe 13*a* may be used.

Figure 15A:
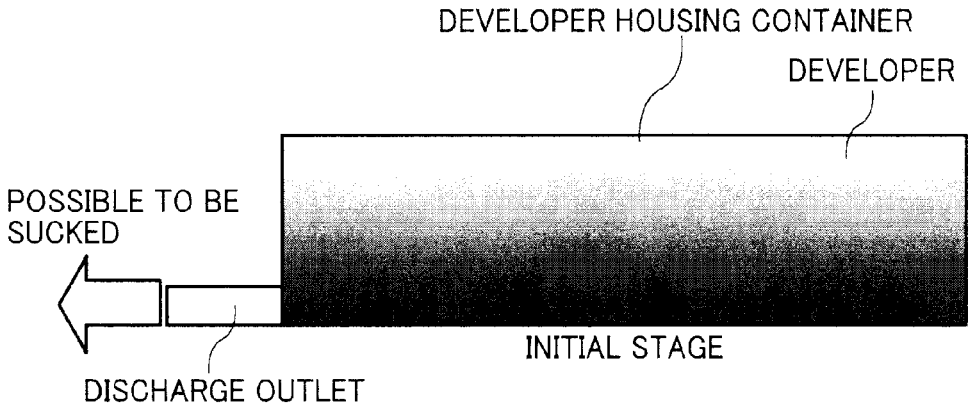
FIGS. 15A and 15B are views schematically explaining a problem of the developer housing container of the soft type.
Figure 15B:
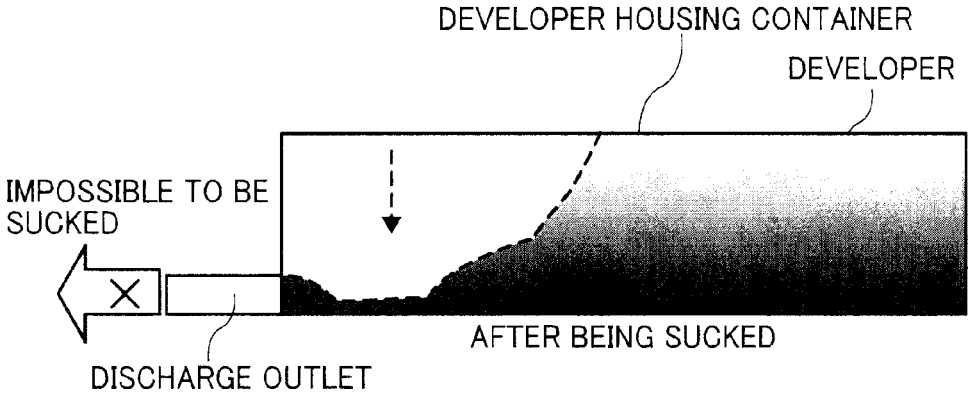
Figure 16A:
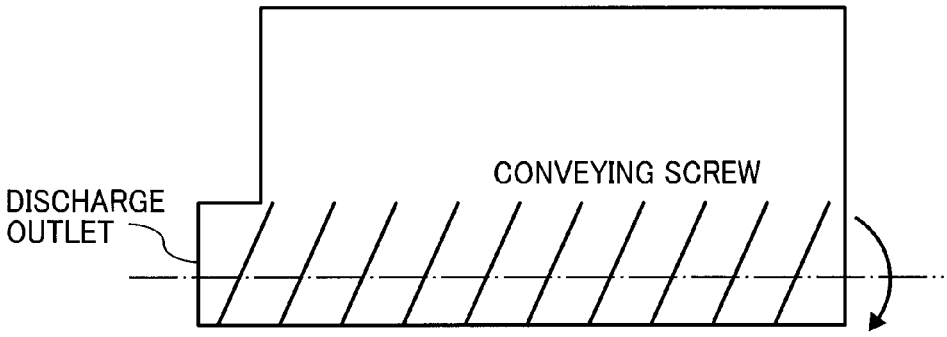
FIGS. 16A to 16C are views showing a developer housing container of a hard-bottle type.
Figure 16B:
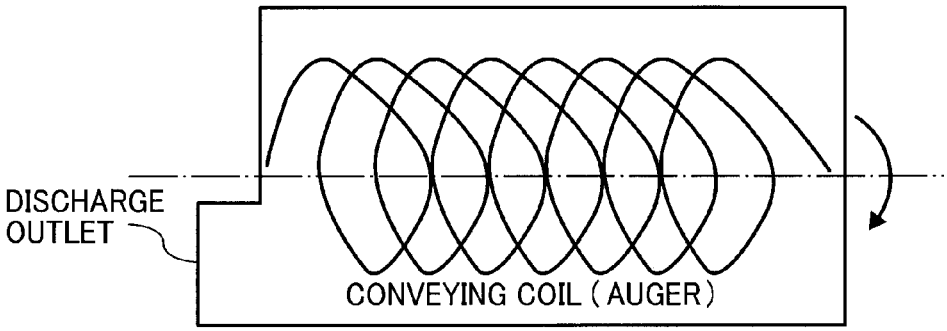
Figure 16C:
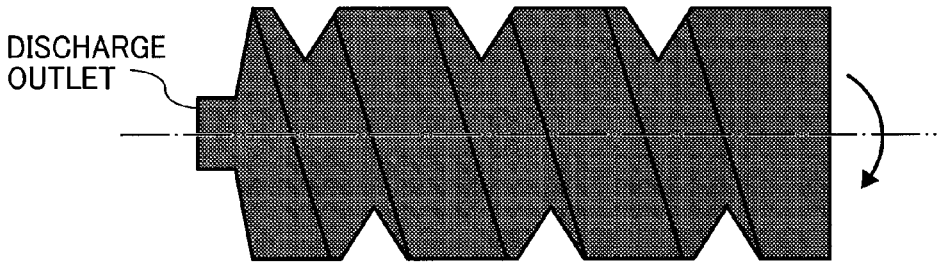

FIGS. 15A and 15B show a conventional example in which the periodic motion is not provided on the developer housing container, and the developer (toner) is not fluidized. As shown in FIG. 15A, since a sufficient amount of the developer is housed in the developer housing container in an initial state, there is a sufficient amount of the developer also near the discharge outlet. Therefore, the developer (toner) can be replenished to the development device through the powder pump, for example. After a while, however, since the developer is not fluidized, the developer near the discharge outlet is depleted as shown in FIG. 15B. Then, the developer (toner) far from the discharge outlet is not moved toward the discharge outlet, and therefore the developer (toner) far from the discharge outlet cannot be discharged although there is the developer (toner) in the developer housing container.

Figure 3A:
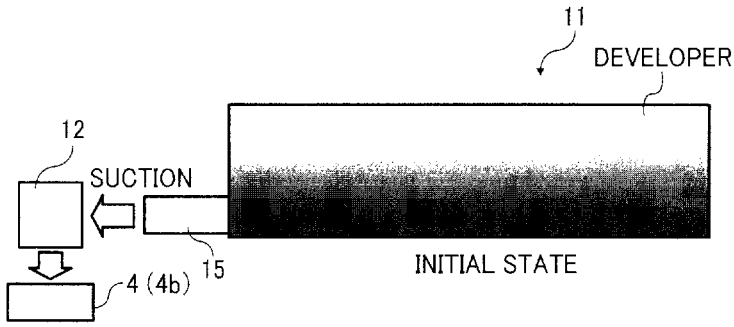
FIGS. 3A and 3B are views showing actions when a motion is provided to a developer housing container.
Figure 3B:
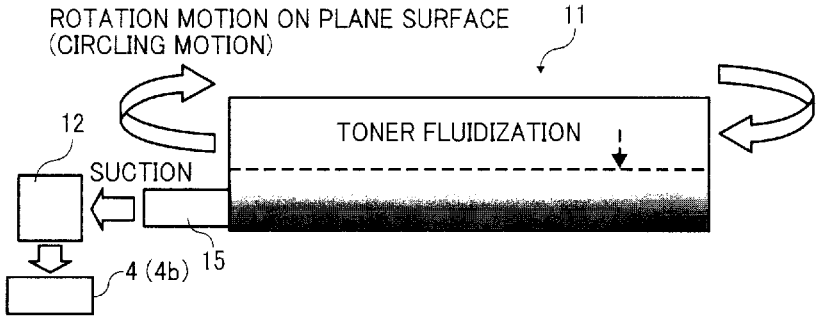

FIGS. 3A and 3B are conceptual diagrams according to an embodiment of the present invention in which the developer is discharged when vibration is provided to the developer (toner) by the motion providing device 14, and the developer (toner) is fluidized. In an initial state shown in FIG. 3A, the developer (toner) is capable of being replenished from the discharge outlet 15 to the development device 4 through the powder pump 12. When the periodic motion is provided to the developer housing container 11 as the developer (toner) is discharged, the developer housing container 11 is vibrated, the vibration reaches the developer (toner), and thereby interspaces are produced between particles of the developer (toner), and interparticle forces acting between particles of the developer (toner) weaken. Accordingly, the developer (toner) in the developer housing container 11 is fluidized. Since the fluidized developer (toner) acts almost like a liquid, the developer (toner) is flattened to be in a horizontal state, and the developer (toner) is capable of being replenished from a side of the discharge outlet 15 to the development device 4 through the powder pump 12.

The periodic motion of the developer housing container 11 by the motion providing device 14 is the circling motion, in which the trajectory of the arbitrary point of the developer housing container 11 on the horizontal plane is the at least one of circular and ellipsoidal trajectories, without the fixed rotation center on the horizontal plane.

As mentioned above, when the circling motion of the developer housing container 11 is provided by the motion providing device 14, the force is applied from all 360-degree directions to the developer in the developer housing container 11. Therefore, the developer is easily fluidized more than in a case where the vibration is applied to the developer housing container 11 by a unidirectional or rectilinear movement as a conventional way.

In a case where a rectilinear vibration is provided to the developer housing container 11 as the conventional way, the developer (toner) is not fluidized, the interspaces between the particles of the developer (toner) are reduced, and a phenomenon called blocking may be caused. However, in a case where the circling motion of the developer housing container 11 is provided, such a phenomenon is not caused, and the developer can be easily fluidized.

The developer housing container 11 may be composed of the flexible member.

Figure 4A:
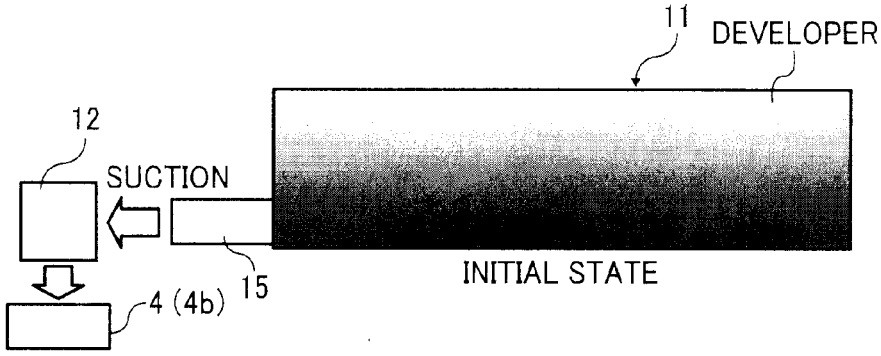
FIGS. 4A and 4B are views showing actions when the motion is provided to a developer housing container of a soft type.
Figure 4B:
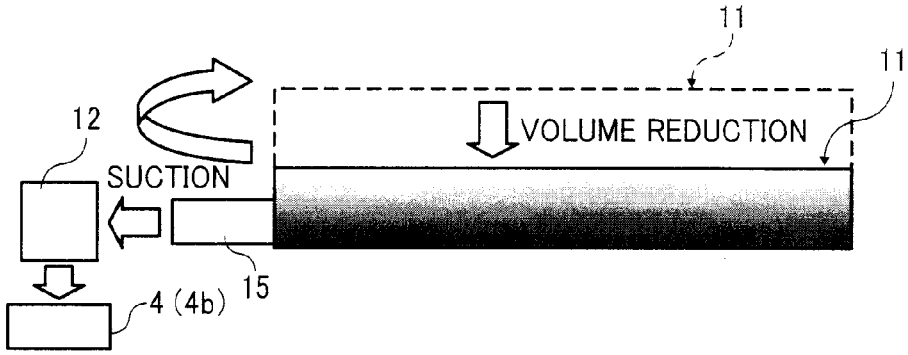

FIGS. 4A and 4B show examples for replenishing the developer from the flexible developer housing container 11 to the development device 4 with the powder pump 12. As shown in FIG. 4A, when the powder pump 12 is operated, the developer is discharged via the suction pipe 13*a* from the discharge outlet 15. Since the developer housing container 11 is sealed, pressure of the developer housing container 11 is reduced as the developer is sucked by the powder pump 12 to be discharged. Therefore, volume of the flexible developer housing container 11 is gradually reduced as shown in FIG. 4B. Conventionally, since the developer (toner) is hard to be fluidized, the developer near the discharge outlet 15 is depleted as shown in FIG. 15B, and it is difficult to convey the developer to the discharge outlet 15. However, as this embodiment, the periodic circling motion is provided, and thereby a large amount of air is included in the developer. Therefore, the developer becomes easily fluidized. When discharge of the developer (toner) is completed, the developer housing container 11 becomes almost planar and thin.

The discharge outlet 15 configured to discharge the developer may be formed, when the developer housing container 11 is placed, at the lower surface 11A of the developer housing container 11 or the lowest portion of a surface 11B in not a horizontal but a vertical direction of the developer housing container 11.

Figure 5A:
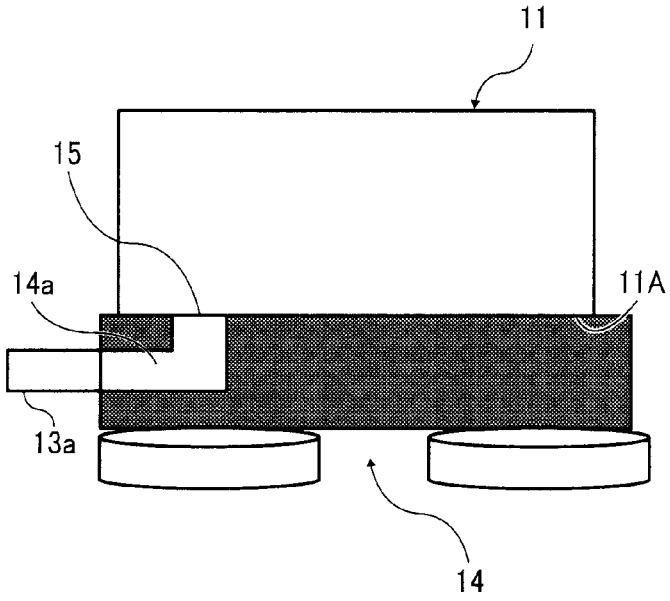
FIGS. 5A and 5B are views showing configurations of the developer housing container.
Figure 5B:
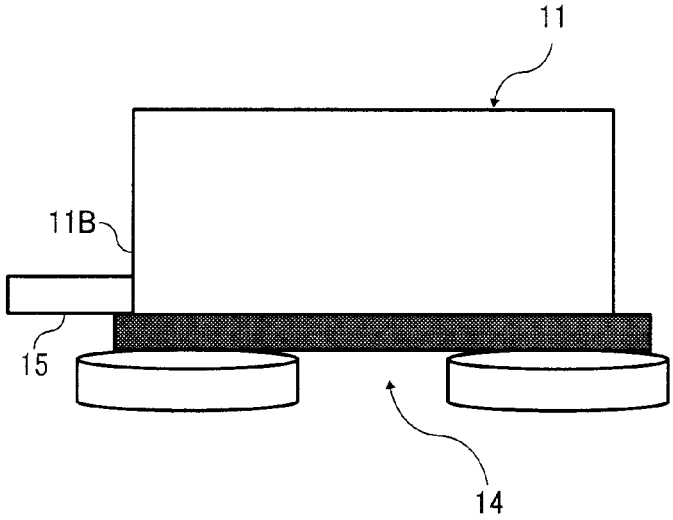
Figures 6A, 6B, 6C, 6D:
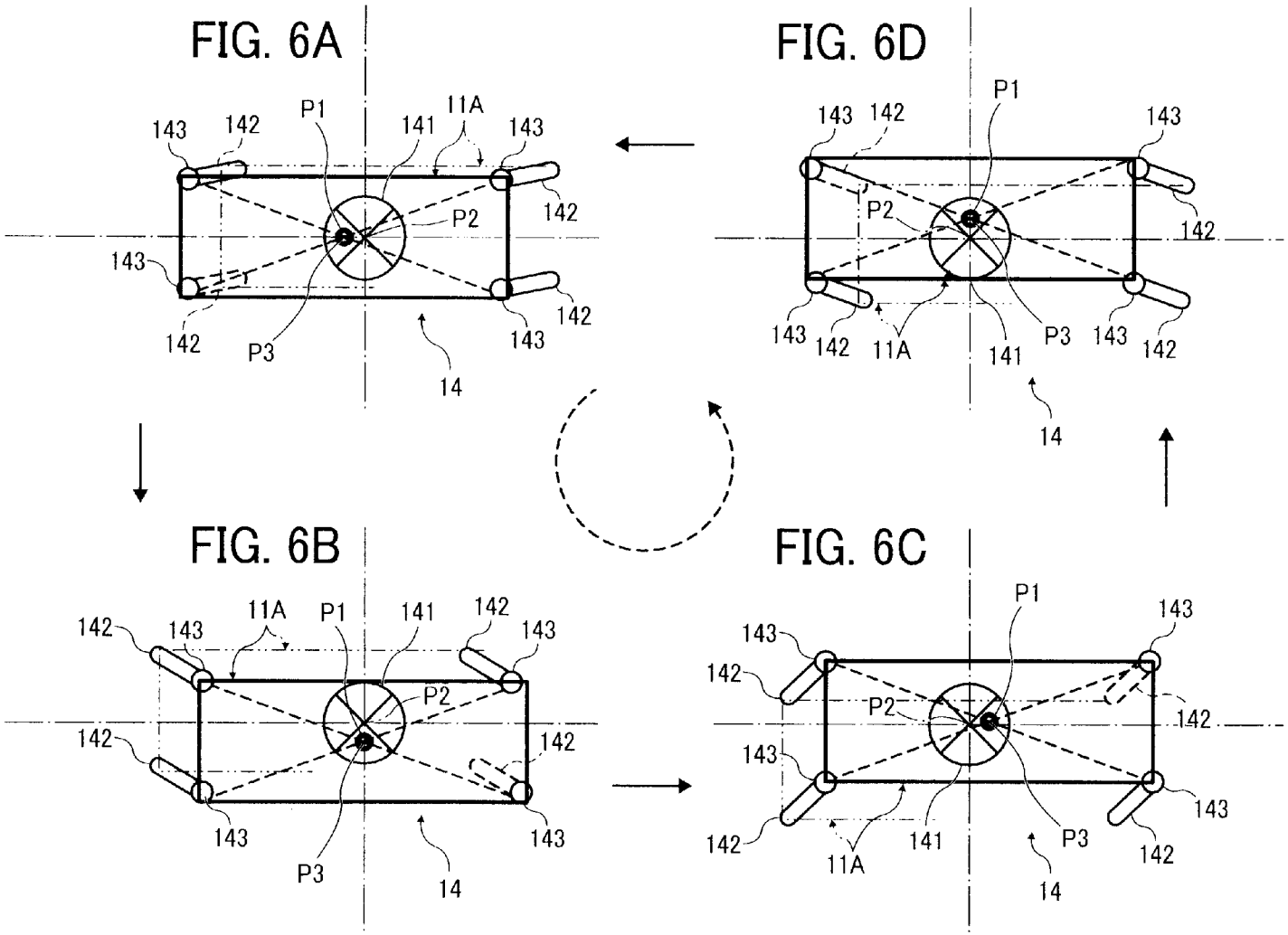
FIGS. 6A to 6D are planar views showing actions in series when a circling motion is provided to the developer housing container.

FIGS. 5A and 5B are views from a side surface of the developer housing container 11. The developer housing container 11 is put on the motion providing device 14 provided under the lower surface 11A of the container. Since the developer (toner) is fluidized by the circling motion of the developer housing container 11, the developer (toner) is fluidized or in liquefaction. Accordingly, it is preferable that the discharge outlet 15 for the developer (toner) be provided on the lower side of the developer housing container 11. That is, the discharge outlet 15 is provided on the lower surface 11A of the developer housing container 11 as shown in FIG. 5A, or the discharge outlet 15 is provided at the lowest portion of a side surface 11B in not a horizontal but a vertical direction of the developer housing container 11 as shown in FIG. 5B, and thereby the developer (toner) is capable of being replenished without remaining in the container. A shielding member such as an openable and closable shutter to prevent the fluidized developer from abruptly inflowing may be provided on the discharge outlet 15. In addition, in a case where the discharge outlet 15 is arranged on the lower surface 11A of the developer housing container 11, it is desirable that the discharge outlet 15 be arranged so as not to intervene in the motion providing device 14, or that a carry-out outlet 14*a* be formed in the motion providing device 14, and the discharge outlet 15 and the suction pipe 13*a* communicate with the carry-out outlet 14*a*.

Thus, in a case where the discharge outlet 15, which is to be a suction outlet, is positioned below the developer housing container 11, there is an advantage for a user in that the developer can be discharged from the developer housing container 11 to outside thereof without remaining therein, and there is no need to change the developer housing container 11 in which the developer remains.

Further, even if a position of the developer housing container 11 and a position of the powder pump 12 are changed, since the flexible member is used for the suction pipe 13*a* connecting the developer housing container 11 and the powder pump 12, the vibration of the developer housing container 11 is absorbed in the suction pipe 13*a* and is hard to reach a side of the apparatus including the powder pump 12 and so on, and it is possible to stably operate the apparatus. Furthermore, since the developer housing container 11 and the development device 4 are capable of communicating with each other by use of the powder pump 12 and the flexible suction pipe 13*a*, it is unnecessary that the position of the developer housing container 11 in the apparatus be close to the development device 4, it is possible to lay out the developer housing container 11 in surplus space in the apparatus body or at a position in which the developer housing container 11 can be easily changed, and it is possible to contribute to downsizing of the image forming apparatus.

Figure 14:
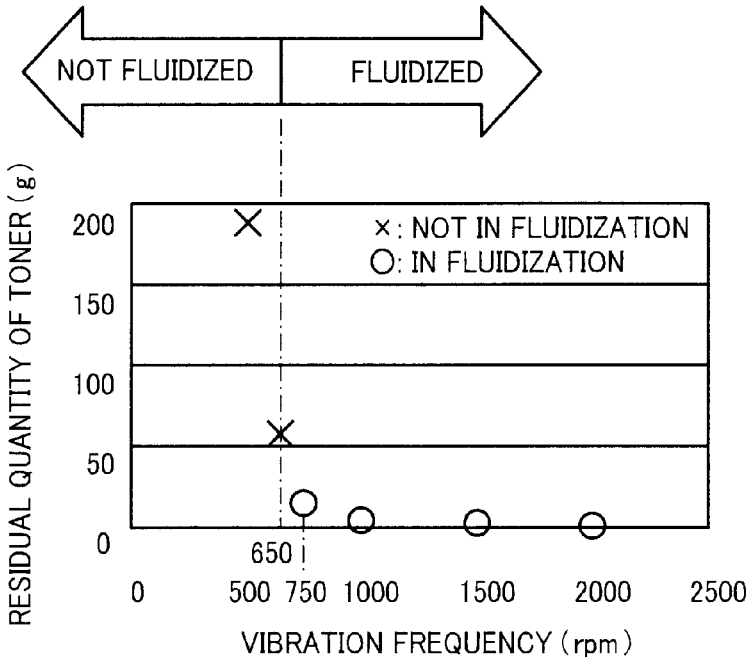
FIG. 14 is a feature view showing a relationship between a vibration frequency to be provided to the developer housing container and residual quantity of toner in the container.

FIG. 14 shows a relationship between a vibration frequency of the circling motion when the circling motion is provided to the developer housing container 11 and the amount of the developer (toner) remaining inside the developer housing container 11 when the developer housed in the developer housing container 11 is replenished.

In FIG. 14, "PxP toner" having an average weight particle diameter of 5.8 μm, which is made by RICOH COMPANY, LTD., is used as the developer. According to FIG. 14, in a case where the vibration frequency of the circling motion is 650 rpm, since a toner fluidization does not continue, much of the toner remains in the developer housing container 11, and the residual quantity of toner increases. However, in a case where the vibration frequency of the circling motion goes up to 750 rpm, the developer is fluidized, the residual quantity of toner can be almost eliminated, and the toner in the developer housing container 11 can be effectively used.

The motion providing device 14 may include one or more rotation bodies, for example, rotors 141 which are eccentric when the horizontal plane is viewed from above and a driving source, for example, a driving motor 144 configured to rotate and drive the one or more rotation bodies 141. The developer housing container 11 may be supported on the one or more rotation bodies 141, so that the circling motion, in which the trajectory of the arbitrary point P1 of the developer housing container 11 on the horizontal plane is the at least one of circular and ellipsoidal trajectories, may be provided.

FIGS. 6A to 6D schematically show the circling motion of the developer housing container 11 when an appearance of the circling motion of the developer housing container 11 is viewed from above, or a planar view thereof is carried out. The lower surface 11A of the container, which is shown by a bold-and-solid line and a dashed double-dotted line in the drawing, is connected or fixed to a black-point part, that is, an eccentric point P3 of the eccentric rotor 141 included in the motion providing device 14 at the center point P1 of the lower surface 11A of the container, at which diagonal lines of the lower surface 11A of the container are intersected. The developer housing container 11 maintains a horizontal state by being supported by a movable supporting member 142 included in the motion providing device 14 via a rubber member 143. The supporting member 142 is not connected to the rotor 141, and if moving in a horizontal direction, the developer housing container 11 is capable of moving in a range of movement of the supporting member 142.

The rotor 141 has a rotation center indicated by a rotation center point P2 at which solid lines are intersected in each of FIGS. 6A to 6D. The rotor 141 rotates about the rotation center point P2, and thereby the circling motion on the horizontal plane is provided to the developer housing container 11. In FIGS. 6A to 6D, in a case where the rotor 141 rotates in a counterclockwise direction, the developer housing container 11 repeatedly moves in sequence as follows: FIG. 6A, FIG. 6B, FIG. 6C, FIG. 6D, and FIG. 6A, and the circling motion, in which the trajectory of the arbitrary point P1 on the horizontal plane draws a circle, is provided. In accordance with a type of the rotor 141, the circling motion, in which the trajectory of the arbitrary point P1 on the horizontal plane draws an ellipsoid, may be provided to the developer housing container 11.

Figure 7:
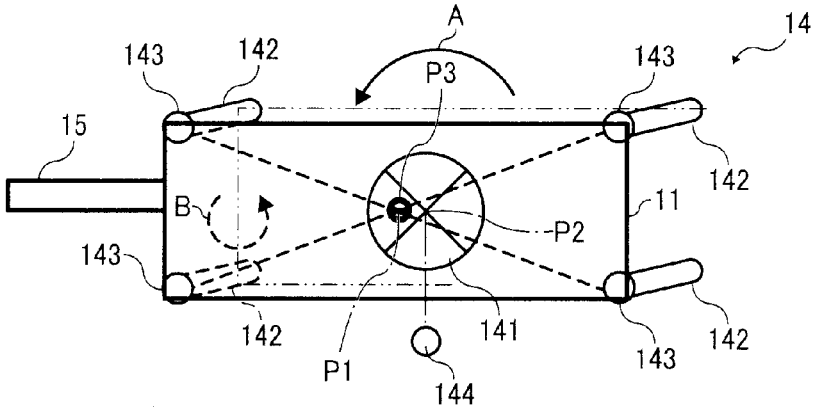
FIG. 7 is a planar view schematically showing an embodiment of a motion providing device which provides the circling motion to the developer housing container.

FIG. 7 is a planar view schematically showing the motion providing device 14 included in the developer replenishing device 10 according to an embodiment of the present invention and the developer housing container 11 supported by the motion providing device 14.

The motion providing device 14 includes the one or more rotors 141 which are eccentric when the horizontal plane is viewed from above, the driving motor 144 which is the driving source to rotate and drive the one or more rotors 141, and a plurality of the supporting members 142. A configuration of this embodiment is almost the same as that shown in FIGS. 6A to 6D.

Regarding the developer housing container 11, the center point P1 as the arbitrary point positioned on the lower surface 11A is supported and fixed by the rotor 141, to which the circling motion is provided, and also four corners of the lower surface 11A are supported from a lower side by the four supporting members 142 made of rubber or formed with a spring and so on, and the circling motion is provided to the developer housing container 11 when the rotor 141 is rotated by the driving motor 144. When a rotation motion in a direction shown by a solid arrow A is provided to the eccentric rotor 141, the circling motion is provided to the developer housing container 11 as shown by a dashed arrow B, with the four supporting members 142 in parallel, and the developer in the developer housing container 11 can be fluidized. In a case of this embodiment, since one rotating eccentric rotor 141 is used, costs regarding the driving motor 144 can be reduced.

Figure 8:
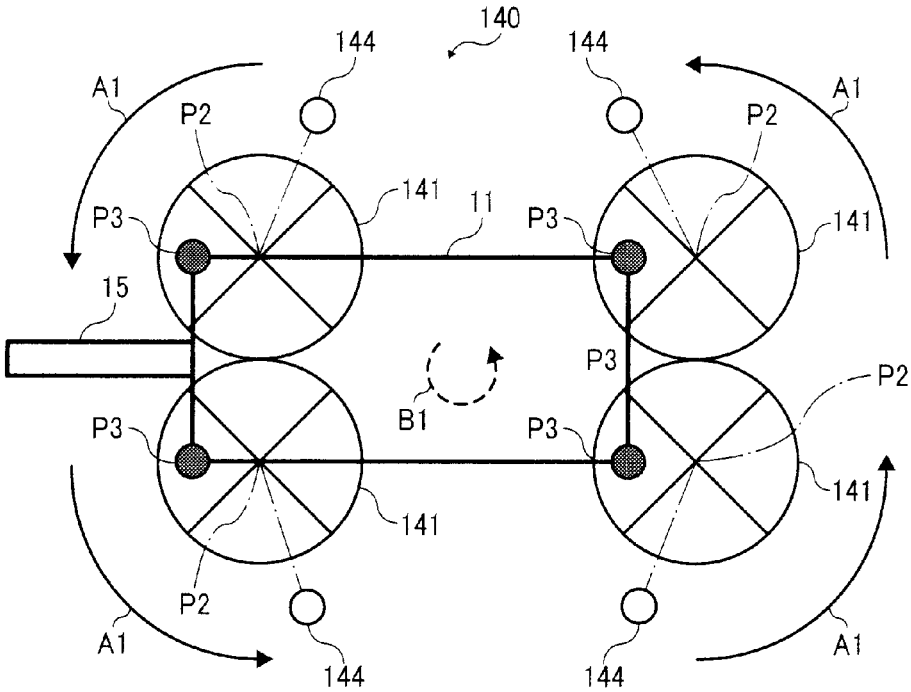
FIG. 8 is a planar view schematically showing another embodiment of the motion providing device which provides the circling motion to the developer housing container.

FIG. 8 shows another embodiment of a motion providing device. The motion providing device 140 does not include the supporting member 142 but includes four eccentric rotors 141, each having a larger diameter than that of the rotor shown in FIG. 7. The developer housing container 11 is put on the four rotors 141 to be supported. The four corners of the lower surface 11A of the developer housing container 11 are connected with the four rotors 141 at the points P3, that is, the black-point parts in the drawing, which are displaced from the center points P2 of the four rotors 141, respectively. Therefore, each of the rotors 141 rotates in conjunction with each other in a direction shown by a solid arrow A1, and thereby it is possible to provide the circling motion in a direction shown by a dashed arrow B1 on the same plane parallel to a plane of paper to the developer housing container 11. In this case, since four points where the developer housing container 11 is supported concurrently rotate or circle, load applied to one rotor 141 is reduced. Accordingly, it is preferable in that durability of the motion providing device 140 is improved.

Figure 9:
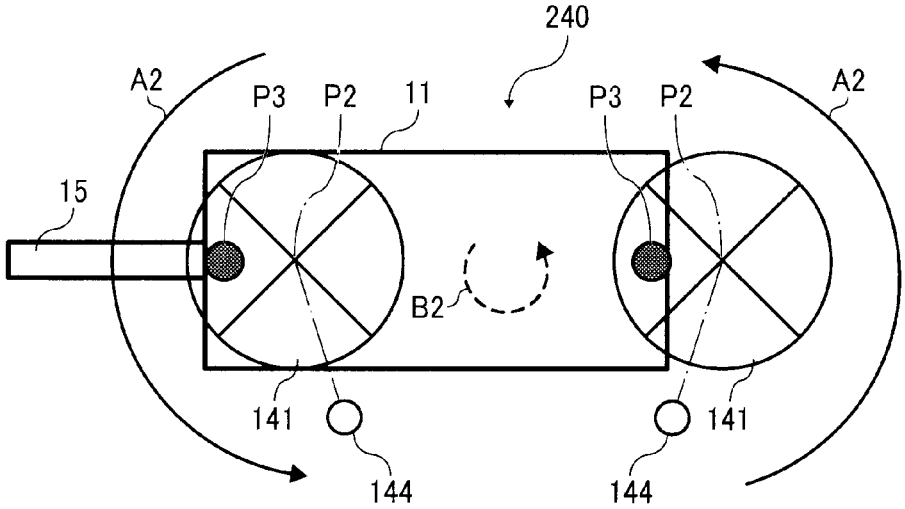
FIG. 9 is a planar view schematically showing another embodiment of the motion providing device which provides the circling motion to the developer housing container.

FIG. 9 shows yet another embodiment of a motion providing device. The motion providing device 240 includes two rotors 141 and supports the developer housing container 11 at edge parts in a longitudinal direction of the lower surface 11A of the developer housing container 11 from a lower side. In this embodiment, the edge parts in the longitudinal direction of the lower surface 11A of the developer housing container 11 are connected with the two rotors 141 at the points P3, that is, the black-point parts in the drawing, which are displaced from the center points P2 of the two rotors 141, respectively.

Therefore, each of the rotors 141 rotates in conjunction with each other in a direction shown by a solid arrow A2, and thereby it is possible to provide the circling motion in a direction shown by a dashed arrow B2 on the same plane parallel to the plane of paper to the developer housing container 11. In this case, since two points where the developer housing container 11 is supported concurrently rotate or circle, load applied to each of the rotors 141 is reduced, and durability of the motion providing device 240 is improved.

Thus, the rotors 141 in various sizes may be used. However, if amplitude, that is, a scope of circling of the developer housing container 11 becomes large, the vibration of the developer housing container 11 becomes too large, and the vibration may influence the image forming apparatus body. Therefore, it is desirable that the amplitude of the rotation of the developer housing container 11 be 10 mm or less, preferably 4 mm or less.

If a flexible developer housing container is used as the developer housing container 11, logistics costs for recovery and transport from users to manufacturers can be reduced. Further, a fold line may be made to the flexible developer housing container as the volume thereof is reduced, and the developer may remain in the fold line. However, as an embodiment of the present invention, the circling motion is provided so that the arbitrary point P1 of the developer housing container 11 draws a circle or an ellipsoid on the horizontal plane, and thereby the developer is fluidized, and further, accelerations are applied to various directions. Therefore, the developer can be suppressed from remaining in the fold line. Further, the developer is prevented from remaining attached to an inside wall surface of the developer housing container 11.

Since the developer is fluidized, the developer can be replenished with good accuracy in a case of being sucked and conveyed by the powder pump 12. Therefore, toner concentration in the development device 4 is stable, and concentration fluctuation of an image in the image forming apparatus can be prevented.

The motion providing device may include a driving device configured to provide two motions, which are intersected with each other, on a horizontal plane to the developer housing container 11. The driving device may be controlled, so that the circling motion, in which the trajectory of the arbitrary point P1 of the developer housing container 11 on the horizontal plane is the at least one of circular and ellipsoidal trajectories, may be provided.

Figure 10:
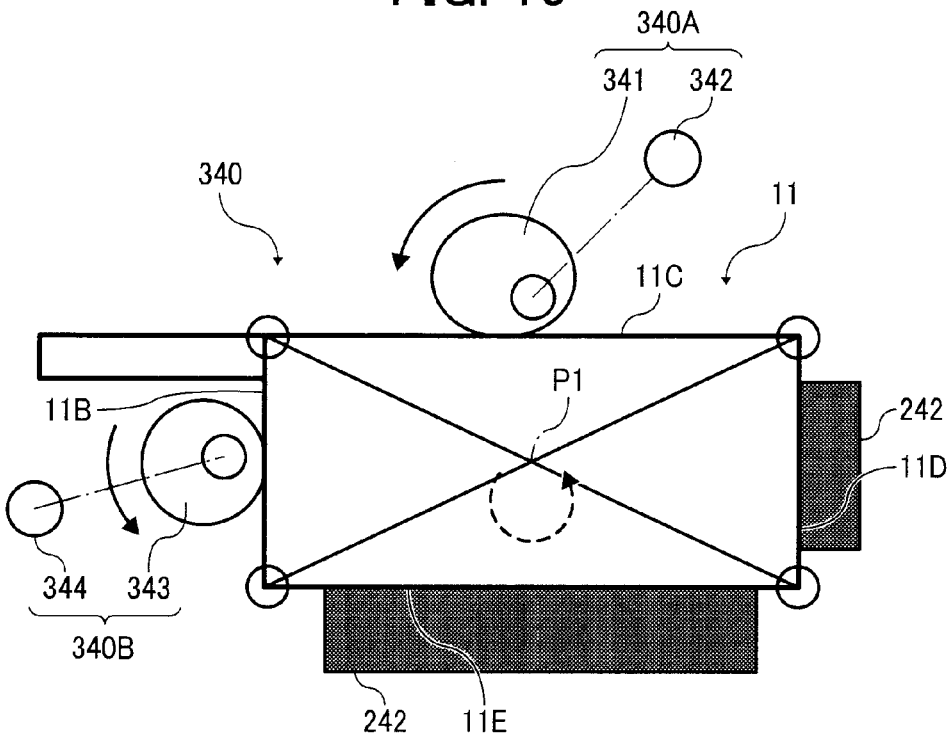
FIG. 10 is a planar view schematically showing an embodiment of a motion providing device which provides the circling motion to the developer housing container.
Figure 11:
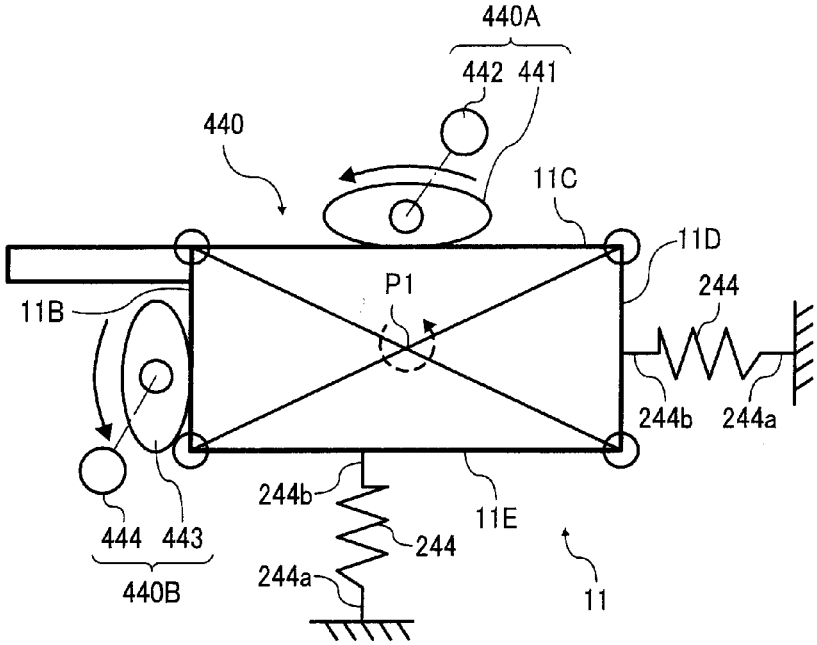
FIG. 11 is a planar view schematically showing another embodiment of a motion providing device which provides the circling motion to the developer housing container.
Figure 12:
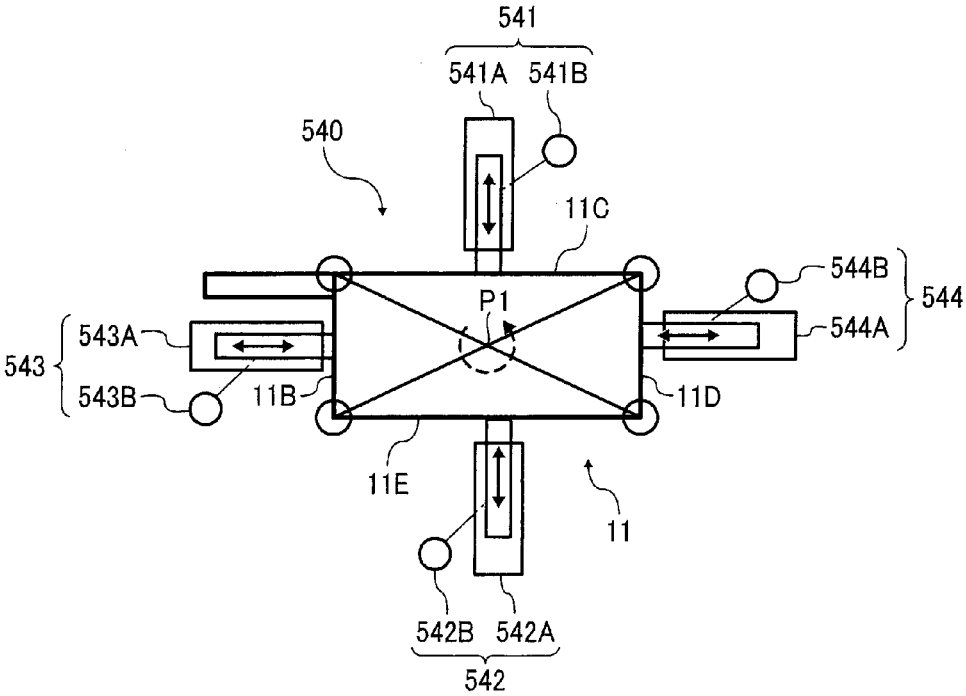
FIG. 12 is a planar view schematically showing another embodiment of a motion providing device which provides the circling motion to the developer housing container.

FIGS. 10 to 12 show different embodiments of a motion providing device to provide the circling motion to the developer housing container 11. In FIGS. 10 to 12, the motion providing device includes the driving device to provide the two motions, which are intersected with each other, on the horizontal plane to the developer housing container 11. The driving device is controlled, so that the circling motion, in which the trajectory of the arbitrary point P1 of the developer housing container 11 on the horizontal plane is the at least one of circular and ellipsoidal trajectories, is provided. The driving device includes a plurality of driving sections.

The driving device may include movable members configured to be in contact with different surfaces of the developer housing container 11 from different directions and driving sources configured to drive the movable members. The movable members may be operated with the driving sources, so that the circling motion, in which the trajectory of the arbitrary point P1 of the developer housing container 11 on the horizontal plane is the at least one of circular and ellipsoidal trajectories, may be provided.

The motion providing device 340 shown in FIG. 10 includes the driving sections 340A, 340B each having an eccentric rotor and a driving motor.

The driving sections 340A, 340B each includes the eccentric rotor 341 (343) as the movable member in contact with the different surface of the developer housing container 11 in the different direction, and the driving motor 342 (344) as the driving source to rotate and drive the eccentric rotor 341 (343). That is, in this embodiment, the two driving sections 340A, 340B to provide strength in the different directions to the developer housing container 11 are included, vibration frequencies and amplitude of the driving section 340A and the driving section 340B are the same, respectively, and thereby the circling motion of the developer housing container 11 is achieved.

In FIG. 10, the eccentric rotor 341 and the eccentric rotor 343 are in a configuration such that circumference surfaces thereof are in contact with a longitudinal side surface 11C of the developer housing container 11 and a short side surface 11B of the developer housing container 11 to provide an eccentric motion to the developer housing container 11, respectively. Cushion members 242 are provided on a longitudinal side surface 11E opposite to the side with the eccentric rotor 341 and a short side surface 11D opposite to the side with the eccentric rotor 343 as a way to absorb shocks caused by contact with surrounding members during vibration, respectively, to provide smooth circling.

According to the motion providing device 340 in such a configuration, the driving motors 342, 344 are driven to operate the eccentric rotors 341, 343 to be rotationally driven, and thereby the circling motion, in which the trajectory of the arbitrary point P1 of the developer housing container 11 on the horizontal plane is circular, is provided to fluidize the developer in the container.

The motion providing device 440 shown in FIG. 11 includes the driving sections 440A, 440B each having an ellipsoidal rotor and a driving motor. The driving sections 440A, 440B each includes the ellipsoidal rotor 441 (443) as the movable member in contact with the different surface of the developer housing container 11 in the different direction, and the driving motor 442 (444) as the driving source to rotate and drive the ellipsoidal rotor 441 (443).

In FIG. 11, the ellipsoidal rotor 441 and the ellipsoidal rotor 443 are in a configuration such that the circumference surfaces thereof are in contact with the longitudinal side surface 11C of the developer housing container 11 and the short side surface 11B of the developer housing container 11 to provide an ellipsoidal circling motion to the developer housing container 11, respectively. Each of spring members 244 has one end 244*a* fixed to a side of the apparatus body and the other end 244*b* fixed to either the longitudinal side surface 11E opposite to the side surface 11C with the ellipsoidal rotor 441 or the short side surface 11D opposite to the side surface 11B with the ellipsoidal rotor 443 as a way to absorb shocks caused by contact with surrounding members during vibration, respectively, to perform smooth rotating.

That is, in this embodiment, the two driving sections 440A, 440B to provide strength in the different directions to the developer housing container 11 are included, vibration frequencies and amplitude of the driving section 440A and the driving section 440B are the same, respectively, and thereby the circling motion of the developer housing container 11 is achieved.

According to the motion providing device 440 in such a configuration, the driving motors 442, 444 are driven to operate the ellipsoidal rotors 441, 443 to be rotationally driven, and thereby the ellipsoidal circling motion, in which the trajectory of the arbitrary point P1 of the developer housing container 11 on the horizontal plane is ellipsoidal, is provided to fluidize the developer in the container.

The motion providing device 540 shown in FIG. 12 includes the four driving sections 541 to 544 each having a cylinder and a driving motor. The driving sections 541 to 544 include the cylinders 541A, 542A, 543A, 544A as the movable members in contact with the different surfaces of the developer housing container 11 in the different directions, and the driving motors 541B, 542B, 543B, 544B as the driving sources to move the cylinders 541A, 542A, 543A, 544A, respectively, the cylinders 541A, 542A, 543A, 544A providing a linear reciprocating motion.

The cylinder 541A and the cylinder 542A are arranged so that one ends thereof are in contact with the longitudinal side surfaces 11C and 11E of the developer housing container 11, respectively. The cylinder 543A and the cylinder 544A are arranged so that one ends thereof are in contact with the short side surfaces 11B and 11D of the developer housing container 11, respectively. That is, the motion providing device 540 is in a configuration so as to provide a vibration in four directions to the developer housing container 11.

Regarding the cylinders 541A, 542A opposite to each other and the cylinders 543A, 544A opposite to each other, the driving motors 541B, 542B, 543B, 544B are controlled so as to move one of the opposite cylinders 541A, 542A (543A, 544A) in a protruding direction in synchronization with the other one of the opposite cylinders 541A, 542A (543A, 544A) moving in a retracting direction. These movements of the cylinders 541A, 542A and the cylinders 543A, 544A are sequentially performed, and thereby the circling motion of the developer housing container 11 can be achieved.

As a configuration of the motion providing device including the driving device to provide the two motions, which are intersected with each other, on the horizontal plane to the developer housing container 11, it is not limited to combinations in FIGS. 10 to 12. For example, a combination of the eccentric rotor 341 shown in FIG. 10 and the spring member 244 shown in FIG. 11, a combination of two of the cylinders 541A to 544A shown in FIG. 12 and the spring member 244 shown in FIG. 11, a combination of two of the cylinders and the two ellipsoidal rotors 441, 443, and the like may be possible. Even in such configurations, the circling motion of the developer housing container 11 can be achieved, and also a drive system can be changed as needed.

As the motion providing devices 340, 440, 540 shown in FIGS. 10 to 12, each of the motion providing devices 340, 440, 540 to provide the circling motion to the developer housing container 11 may be divided into drive sources which add strength to the longitudinal side surface of the developer housing container 11 and the short side surface of the developer housing container 11, and thereby, in addition to the simple circling motion, the ellipsoidal circling motion, an 8-shaped motion, and the like can be also achieved. In this manner, the ellipsoidal circling motion and the 8-shaped motion are also provided to the developer housing container 11, and thereby the strength is added from various angles to the developer in the container as well as in a case of the circling motion. Accordingly, the developer in the container can be fluidized.

For example, if a driving section for the longitudinal side surface is vibrated in a simple harmonic motion, and a driving section for the short side surface is vibrated in the simple harmonic motion having the same cycle and amplitude as those of the driving section for the longitudinal side surface, the vibration, in which the trajectory of the arbitrary point P1 draws the circle, can be provided to the developer housing container 11. If the cycles or the amplitudes of the driving section for the longitudinal side surface and the driving section for the short side surface are not the same, respectively, the vibration, in which the trajectory of the arbitrary point P1 draws the ellipsoid, can be provided to the developer housing container 11.

That is, since the circling motion is produced by the two motions intersected with each other on the horizontal plane, by controlling the driving device configured to provide the two motions intersected with each other on the horizontal plane, it is possible to provide the motions in each of which the trajectory of the arbitrary point P1 draws either the 8-shape or the ellipsoid, as well as the circling motion in which the trajectory of the arbitrary point P1 draws the circle. In this way, the motions, each of which has the same speed, of the developer housing container 11 change, and thereby, for example, by the 8-shaped motion, the motion of the developer in the container is accelerated, and the developer is easily fluidized. The developer is more easily fluidized by a direction of the provided vibration being changed than by a one-dimensional vibration (the circling motion).

Further, the vibration frequency by the driving section in a short direction, that is, in this embodiment, an orthogonal direction to a longitudinal direction of the developer housing container 11 is doubled relative to that by the driving section in the longitudinal direction, and thereby the 8-shaped motion to the developer housing container 11 can be provided. Since the accelerations to be applied to the developer in the container are variously changed by the 8-shaped motion, the motion is more easily provided, and the developer in the container can be fluidized by a smaller amplitude than that of a circular vibration. Furthermore, by a combination of the motions of the driving section to vibrate the developer housing container 11 in the longitudinal direction and the driving section to vibrate the developer housing container 11 in the orthogonal direction to the longitudinal direction, it is possible to provide the circling motion or the ellipsoidal circling motion to the developer housing container 11. For example, in a case where the amplitudes of the orthogonal direction and the longitudinal direction are the same, the vibration frequency in the orthogonal direction is doubled relative to that in the longitudinal direction, and thereby the 8-shaped motion can be achieved. Further, since the rotor may be downsized relative to the container, downsizing is easily achieved.

In a case of a full-color printer, four development devices which have toners of Yellow, Magenta, Cyan, and Black, respectively are included, and the same number of developer replenishing devices 10 as the development devices are arranged. In a case where an image forming apparatus is equipped with a plurality of the developer replenishing devices 10 in this manner, a plurality of vibrating devices are vibrated so as to be in antiphase, and thereby it is possible to prevent vibrations by the motion providing devices from affecting a writing system for each of photoreceptor bodies, a conveying system, and an image forming engine section.

Figure 13:
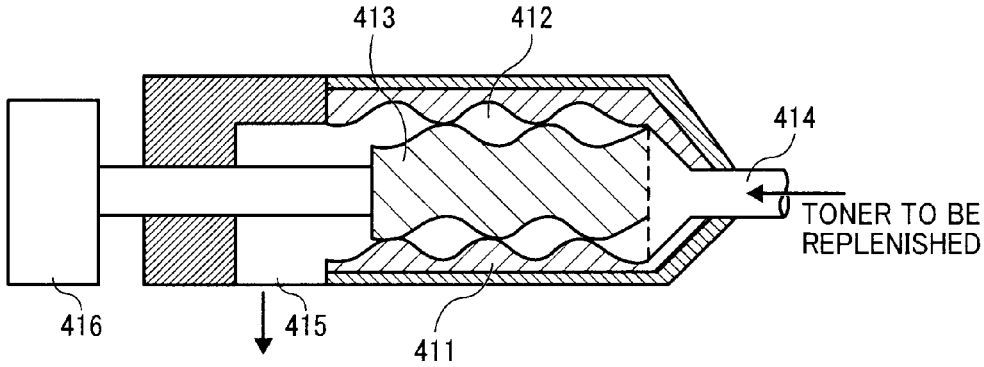
FIG. 13 is a magnified view showing an embodiment of a powder pump which sucks the developer in the developer housing container.

FIG. 13 shows an embodiment of the powder pump 12 in the developer replenishing device 10. The powder pump 12 is a so-called single-axis eccentric powder pump. A rotor 413 in the powder pump 12 is rotated by a driving portion 416 such as a motor, space 412 surrounded by the rigid rotor 413 and a stator 411, which is arranged around the rigid rotor 413 and made with flexible materials, moves from an entrance side 414 for the developer (toner) to be replenished to an exit side 415, and thereby the suction power is generated, and the developer in the developer housing container 11 is sucked.

A shape of the powder pump 12 shown in FIG. 13 is formed so that the rotor 413 is in a single-threaded spiral shape and has an external diameter $\phi 9.55/\phi 11.75$ and a length 13.5 mm, and the stator 411 is in a double-threaded spiral shape and has an internal diameter $\phi 13.4/\phi 9.0$ and a length 13.5 mm. The powder pump 12 is driven at a rotation frequency of 300 rpm, and thereby suction pressure of 30 kPa or more is generated to suck the developer. Normally, the powder pump 12 is used at the pressure of about 10 kPa, and the rotation frequency and rotation time of the pump are controlled in accordance with the amount of the developer to be replenished. The shapes of the rotor 413 and the stator 411 and a condition of the rotation frequency may be set according to types and the amount of the developer to be replenished.

Regarding the developer (toner) used in the image forming apparatus, volume average particle diameters of the toner are generally 2 to 8 μm in order to achieve a high-quality image. Weight average particle diameters of this toner are 3 to 7 μm, further preferably, are 4 to 6 μm. In a case where the weight average particle diameter is less than 3 μm, problems in that an inside of the apparatus becomes dirty by the toner scattered in prolonged use, image density is lowered under a low-humidity environment, a poor cleaning for the photoreceptor body is performed, and the like easily arise, and effects on the human body are also of concern. Further, in a case where the weight average particle diameter is more than 8 μm, resolution in a tiny spot of 100 μm or less is insufficient, much toner is scattered to a non-image area, and an image quality level tends to be inferior.

The toner is mainly made from a resin component, a pigment component, a wax component, and an outer additive. As the resin, there are polystyrene resin, epoxy resin, polyester resin, polyamide resin, styrene acrylic resin, styrene methacrylate resin, polyurethane resin, vinyl resin, polyolefin resin, styrene-butadiene resin, phenolic resin, polyethylene resin, silicone resin, butyral resin, terpene resin, polyol resin, and the like. As the vinyl resin, there are polymer of styrene or a substitution product of the styrene such as polystyrene, poly-p-chlorostyrene, and polyvinyl toluene: styrene copolymer such as styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-methyl chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleic acid ester copolymer: polymethylmethacrylate, polybutylmethacrylate, polyvinyl chloride, polyvinyl acetate, and the like.

The polyester resin is made from divalent alcohol as shown in the following group A and dibasic acid salt as shown in the following group B. Further, the polyester resin may be made from, as a third component, 3 or more valent alcohol or 3 or more valent carboxylic acid as shown in the following group C.

Group A: ethylene glycol, triethylene glycol, 1,2-propylene glycol, 1,3-propylene glycol, 1,4 butanediol, neopentyl glycol, 1,4 butenediol, 1,4-bis(hydroxymethyl)cyclohexane, bisphenol-A, hydrogenation bisphenol-A, polyoxyethylene bisphenol-A, polyoxypropylene (2,2)-2,2'-bis(4-hydroxyphenyl) propane, polyoxypropylene (3,3)-2,2-bis(4-hydroxyphenyl) propane, polyoxy-ethylene (2,0)-2,2-bis(4-hydroxyphenyl) propane, polyoxypropylene (2,0)-2,2'-bis(4-hydroxyphenyl) propane, and the like.

Group B: maleic acid, fumaric acid, mesaconic acid, citraconic acid, itaconic acid, glutaconic acid, phthalic acid, isophthalic acid, terephthalic acid, cyclohexanedicarboxylic acid, succinic acid, adipic acid, sebacic acid, malonic acid, linolenic acid, further, ester of acid anhydride thereof or lower alcohol thereof, and the like.

Group C: 3 or more valent alcohol such as glycerin, trimethylolpropane, pentaerythritol, and the like, 3 or more valent carboxylic acid such as trimellitic acid, pyromellitic acid, and the like, and so on. As the polyol resin, there are alkylene oxide adduct of the epoxy resin and divalent phenol, a chemical compound having one active hydrogen, which is reacted to glycidyl ether thereof and epoxy group thereof, in a molecule, a chemical compound having two or more active hydrogens, which are reacted to the glycidyl ether thereof and the epoxy group thereof, in a molecule, or the like.

The following are used as pigments.

As a black pigment, there are azine series color, metallic salt azo color, metal oxide, and combined metal oxide such as carbon black, oil furnace black, channel black, lampblack, acetylene black, and aniline black.

As a yellow pigment, there are cadmium yellow, Mineral Fast Yellow, Nickel Yellow, Naples Yellow, naphthol yellow S, Hansa Yellow G, Hansa Yellow 10G, benzidine yellow GR, quinoline yellow lake, Permanent Yellow NCG, tartrazine lake, and the like.

As an orange pigment, there are molybdenum orange, Permanent Orange GTR, pyrazolone orange, Vulcan Orange, Indanthrene Brilliant Orange RK, benzidine orange G, Indanthrene Brilliant Orange GK, and the like.

As a red pigment, there are iron oxide red, cadmium red, Permanent Red 4R, Lithol Red, pyrazolone red, watching red calcium salt, lake red D, brilliant carmine 6B, eosin lake, rhodamine lake B, alizarin lake, brilliant carmine 3B, and the like.

As a purple pigment, there are fast violet B, methyl violet lake, and the like.

As a blue pigment, there are cobalt blue, alkali blue, Victoria Blue Lake, phthalocyanine blue, metal-free phthalocyanine blue, phthalocyanine blue partial chloride, Fast Sky-Blue, Indanthrene Blue BC, and the like.

As a green pigment, there are chrome green, chrome oxide, pigment green B, malachite green lake, and the like.

One or two kinds thereof can be used. Especially in a color toner, good homogeneous dispersion of the pigment is essential. A system not to directly put the pigment in a large amount of the resin but to make a master batch, in which the pigment is dispersed once in high concentration, and put the master batch in the large amount of the resin in a manner that attenuates the master batch is used. In this case, generally, a solvent is used in order to help dispersibility. However, since there are problems about the environment and so on, water is used for the dispersion in an embodiment of the present invention. In a case of using water, a temperature control becomes important so that residual water in the master batch does not become a problem.

An electric charge controlling agent is blended in or internally attached to a particle of the toner for the toner in an embodiment of the present invention. A perfect electric charge quantity control according to a development system becomes possible by the electric charge controlling agent. In particular, in the development device of an embodiment of the present invention, it is possible to have a balance between particle size distribution and electric charge quantity to be further stable. In order to control the toner to be in a positive electric charge characteristic, nigrosine, quaternary ammonium salt, triphenylmethane series dye, and metal complex or salt of imidazole, may be used singly or by a combination of two or more kinds thereof. Further, in order to control the toner to be in a negative electric charge characteristic, salicylic acid metal complex, the salt, organoboron salt, calixarene series chemical compound, and the like are used. Furthermore, a mold release agent may be internally attached to the toner in an embodiment of the present invention in order to prevent offset during fixation. As the mold release agent, there are candelilla wax, carnauba wax, natural wax such as rice wax, montan wax and its derivative, paraffin wax and its derivative, polyolefin wax and its derivative, SASOL wax, low-molecular-weight polyethylene, low-molecular-weight polypropylene, alkyl phosphoric acid ester, and the like. It is favorable that melting points of these mold release agents be in a range of 65 to 90 degrees Celsius. In a case where the melting points are lower than in this range, blocking during keeping of the toner may easily occur, and in a case where the melting points are higher than in this range, the offset may easily occur in an area in a low fixing temperature.

For such an objective as improving dispersibility of the mold release agent and so on, an additive may be added. As the additive, there are the styrene acrylic resin, the polyethylene resin, the polystyrene resin, the epoxy resin, the polyester resin, the polyamide resin, the styrene methacrylate resin, the polyurethane resin, the vinyl resin, the polyolefin resin, the styrene-butadiene resin, the phenolic resin, the butyral resin, the terpene resin, the polyol resin, and the like. The additive in which two or more kinds of those resins are mixed may be also usable.

Crystalline polyester may be used for the resin. The crystalline polyester is aliphatic system polyester which has a crystalline characteristic, in which the molecular weight distribution is sharp, and in which the absolute quantity of low-molecular weight of the molecular weight distribution is as much as possible. The resin initiates a crystalline transition at a glass-transition temperature (Tg), and at the same time, melt viscosity is drastically lowered from a solid condition, and a fixing function to paper appears. By the use of the crystalline polyester resin, low-temperature fixation can be achieved without lowering the Tg and molecular weight of the resin too much. Therefore, a keeping quality is not lowered by Tg lowering. Further, there is neither too high a luster nor worsened anti-offset performance accompanied with the low-molecular weight. Accordingly, an adoption of the crystalline polyester resin is very effective for improving a low-temperature fixation performance of the toner.

As the toner used for the image forming apparatus according to an embodiment of the present invention, since it is desirable that cohesion degree thereof be low, inorganic micro-powder as a flow improver may be attached or fixed to a toner surface. 10 to 200 [nm] are suitable for an average particle diameter of the inorganic micro-powder. In a case of a particle diameter which is smaller than 10 [nm], it is difficult to produce a concave-convex surface which is effective for fluidity, and in a case of the particle diameter which is larger than 200 [nm], a powder shape becomes rough, and a problem in a toner shape arises.

As the inorganic micro-powder in an embodiment of the present invention, there are oxide, hydroxide, carbonate, sulfide, and composite oxide such as Si, Ti, Al, Mg, Ca, Sr, Ba, In, Ga, Ni, Mn, W, Fe, Co, Zn, Cr, Mo, Cu, Ag, V, Zr, and the like. Among the above-mentioned, the following oxides are often adopted in terms of safety, stability, and so on.

In particular, particulates of silicon oxide (silica), titanium oxide (titania), and aluminum oxide (alumina, corundum) are preferably used. Further, it is effective to perform a surface reforming treatment on the additive by a hydrophobizing treatment agent, and so on. A typical example of the hydrophobizing treatment agent is a silane coupling agent as follows.

There are dimethyl dichlorosilane, trimethylchlorosilane, methyltrichlorosilane, allyl dimethyl dichlorosilane, allyl phenyl dichlorosilane, benzil dimethyl chlorosilane, bromine methyl dimethyl chlorosilane, alpha-chloroethyl trichlorosilane, p-chloroethyl trichlorosilane, chloromethyl dimethyl chlorosilane, chloromethyl trichlorosilane, hexaphenyldisilazane, hexatolyldisilazane, and so on.

A hydrophobizing treatment is performed on the additive, and thereby it becomes difficult for the water to adsorb onto a surface of the additive which is a nanoparticle, and an easy toner fluidization is stabilized.

According to an embodiment of the present invention, the circling motion, in which the trajectory of the arbitrary point P1 of the developer housing container 11 draws the circle or the ellipsoid on the horizontal plane, is provided, and thereby the strength is added from the various angles in a horizontal-plane direction to the developer in the container. Therefore, the developer can be efficiently fluidized more than in a case where the vibration is applied to the developer housing container 11 by a unidirectional linear reciprocating motion as in the conventional way, and also the amount of the developer remaining in the developer housing container 11 can be reduced by the fluidization.

The circling motion, in which the arbitrary point P1 of the developer housing container 11 on the horizontal plane draws the circle or the ellipsoid, is provided, and thereby the vibration reaches a whole developer layer. Therefore, the developer is fluidized from an upper portion of the developer layer, the fluidization of a whole developer in the developer housing container 11 proceeds, and the developer becomes easily fluidized. By the whole developer being fluidized, sucking of the developer is stably performed, and the amount of the developer to be replenished to the development device 4 is stabilized. Therefore, the developer can be stably supplied to the latent image on the image carrier, and a good image can be obtained.

Further, since the developer in the developer housing container 11 is fluidized by an operation from outside of the container, the developer can be replenished from inside of the developer housing container 11 to the development device 4 without a conveying member or an air introducing device being provided in the flexible developer housing container 11. Furthermore, even if a great deal of the developer is filled in the developer housing container 11, the developer can be fully fluidized. Therefore, even in the developer housing container 11 having the same dimension as that of the container having a conveying member or an air-introducing device, a great deal of the developer can be housed, a replacement cycle of the developer housing container 11 can be prolonged, and the number of images to be formed can be also increased.

Although the present invention has been described in terms of exemplary embodiments, it is not limited thereto. It should be appreciated that variations may be made in the embodiments described by persons skilled in the art without departing from the scope of the present invention as defined by the following claims.

What is claimed is:

1. A developer replenishing device for replenishing a developer to a development device, comprising:

a developer housing container configured to house the developer inside the container, and supported by the developer replenishing device in a substantially horizontal state;

a discharge outlet provided on the developer housing container and configured to discharge the housed developer outside the container;

a conveying device provided between the discharge outlet and the development device, and configured to convey the developer in the developer housing container to the development device; and a motion providing device configured to provide a periodic motion to the developer housing container, wherein the motion providing device moves the container so that the movement of the container has a circular trajectory in a horizontal plane.

2. The developer replenishing device according to claim 1, wherein the motion providing device includes one or more rotation bodies which are eccentric when the horizontal plane is viewed from above and a driving source configured to rotate and drive the one or more rotation bodies; and the developer housing container is supported on the one or more rotation bodies, so that the movement of the container has at least one of a circular and an ellipsoidal trajectory.

3. The developer replenishing device according to claim 1, wherein the motion providing device includes a driving device configured to provide two motions, which are intersected with each other, on the horizontal plane to the developer housing container; and the driving device is controlled so that the movement of the container has at least one of a circular and an ellipsoidal trajectory.

4. The developer replenishing device according to claim 3, wherein the driving device includes movable members configured to be in contact with different surfaces of the developer housing container from different directions and driving sources configured to drive the movable members; and the movable members are operated with the driving sources so that the movement of the container has at least one of a circular and an ellipsoidal trajectory.

5. The developer replenishing device according to claim 1, wherein the discharge outlet configured to discharge the developer is formed, when the developer housing container is placed, at a lower surface of the developer housing container or the lowest portion of a surface in not a horizontal but a vertical direction of the developer housing container.

6. The developer replenishing device according to claim 1, wherein the conveying device includes a powder pump configured to generate suction power and a pipeline member configured to connect the powder pump and the discharge outlet; and the powder pump is operated, so that the developer in the developer housing container is sucked and conveyed to the development device.

7. The developer replenishing device according to claim 6, wherein the pipeline member is composed of a flexible member.

8. The developer replenishing device according to claim 1, wherein the developer housing container is composed of a flexible member.

9. An image forming apparatus, comprising:

a development device; and a developer replenishing device configured to replenish a developer to be replenished to the development device, wherein the developer replenishing device includes a developer housing container configured to house the developer inside the container, a discharge outlet provided on the developer housing container and configured to discharge the housed developer outside the container, a conveying device provided between the discharge outlet and the development device, and configured to convey the developer in the developer housing container to the development device, and a motion providing device configured to provide a periodic motion to the developer housing container; and wherein the motion providing device moves the container so that the movement of the container has a circular trajectory in a horizontal plane.

10. The image forming apparatus according to claim 9, wherein the motion providing device includes one or more rotation bodies which are eccentric when the horizontal plane is viewed from above and a driving source configured to rotate and drive the one or more rotation bodies; and the developer housing container is supported on the one or more rotation bodies so that the movement of the container has at least one of a circular and an ellipsoidal trajectory.

11. The image forming apparatus according to claim 9, wherein the motion providing device includes a driving device configured to provide two motions, which are intersected with each other, on the horizontal plane to the developer housing container; and the driving device is controlled so that the movement of the container has at least one of a circular and an ellipsoidal trajectory.

12. The image forming apparatus according to claim 11, wherein the driving device includes movable members configured to be in contact with different surfaces of the developer housing container from different directions and driving sources configured to drive the movable members; and the movable members are operated with the driving sources so that the movement of the container has at least one of a circular and an ellipsoidal trajectory.

13. The image forming apparatus according to claim 9, wherein the discharge outlet configured to discharge the developer is formed, when the developer housing container is placed, at a lower surface of the developer housing container or the lowest portion of a surface in not a horizontal but a vertical direction of the developer housing container.

14. The image forming apparatus according to claim 9, wherein the conveying device includes a powder pump configured to generate suction power and a pipeline member configured to connect the powder pump and the discharge outlet; and the powder pump is operated, so that the developer in the developer housing container is sucked and conveyed to the development device.

15. The image forming apparatus according to claim 14, wherein the pipeline member is composed of a flexible member.

16. The image forming apparatus according to claim 9, wherein the developer housing container is composed of a flexible member.

17. A developer replenishing method used in a developer replenishing device for replenishing a developer to a development device, the developer replenishing device including a developer housing container configured to house the developer inside the container, a discharge outlet provided on the developer housing container and configured to discharge the housed developer outside the container, a conveying device provided between the discharge outlet and the development device, and configured to convey the developer in the developer housing container to the development device, and a motion providing device configured to provide a periodic motion to the developer housing container, the method comprising the steps of:

providing the periodic motion to the developer housing container housing the developer to fluidize the housed developer, wherein the motion providing device moves the container so that the movement of the container has a circular trajectory in a horizontal plane;

discharging the fluidized developer from the discharge outlet; and conveying the discharged developer to the development device.

* * * * *